US007252530B2

(12) United States Patent
Shamoto

(10) Patent No.: US 7,252,530 B2
(45) Date of Patent: Aug. 7, 2007

(54) CONNECTOR

(75) Inventor: Wataru Shamoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/519,640

(22) Filed: Sep. 12, 2006

(65) Prior Publication Data

US 2007/0059969 A1 Mar. 15, 2007

(30) Foreign Application Priority Data

Sep. 13, 2005 (JP) ..... 2005-265501

(51) Int. Cl.
*H01R 13/627* (2006.01)

(52) U.S. Cl. ..... 439/352; 439/489

(58) Field of Classification Search ..... 439/353, 439/354, 357, 358, 488, 489
See application file for complete search history.

(56) References Cited

U.S. PATENT DOCUMENTS

| | | | | |
|---|---|---|---|---|
| 5,879,180 | A | 3/1999 | Iwahori et al. | 439/352 |
| 5,997,344 | A | 12/1999 | Shinozaki | 439/489 |
| 6,024,595 | A * | 2/2000 | Saba et al. | 439/352 |
| 6,059,598 | A | 5/2000 | Yamashita et al. | 439/352 |
| 6,126,480 | A * | 10/2000 | Kawase et al. | 439/489 |
| 6,383,009 | B2 * | 5/2002 | Kawase et al. | 439/352 |
| 6,644,996 | B2 * | 11/2003 | Yamashita | 439/352 |
| 6,688,907 | B2 * | 2/2004 | Yamaoka et al. | 439/489 |
| 6,692,288 | B2 | 2/2004 | Nimura | 439/352 |
| 2003/0171027 | A1 | 9/2003 | Shuey et al. | |

FOREIGN PATENT DOCUMENTS

EP 1 237 232 A2 9/2002

* cited by examiner

*Primary Examiner*—Hien Vu
(74) *Attorney, Agent, or Firm*—Gerald E. Hespos; Anthony J. Casella

(57) ABSTRACT

A female connector (F) has a female housing (10) with a main body (11) and a lock arm (13) formed on an upper surface of the main body (11). A detector (40) is mounted on the upper surface of the lock arm (13) for movement between a standby position and a detecting position along a connecting direction of two connectors (F, M). Bulges (49) bulge out sideways from the opposite lateral edges of a resilient locking piece (41) provided in the detector (40). The bulges (49) engage an opening edge (29) of a locking hole (22) at the upper surface of the lock arm (13) to prevent the resilient locking piece (41) from being resiliently deformed down to insert a locking section (42) into the locking hole (22).

7 Claims, 15 Drawing Sheets

CONNECTOR

BACKGROUND OF THE INVENTION

1. Field of the Invention

The invention relates to a connector.

2. Description of the Related Art

U.S. Pat. No. 6,692,288 discloses a detecting connector assembly with male and female connectors and a lock arm for locking the connectors in a properly connected state. A detector is mounted to cover the upper surface of the lock arm and is movable between a standby position and a detecting position. A locking hole penetrates a free-end of the lock arm, and a resilient locking piece projects forward from the front end of the detector. The resilient locking piece engages the front wall of the locking hole in a partly connected state of the connectors to prevent movement of the detector from the standby position to the detecting position. The resilient locking piece is deformed up and disengages from the front wall when the connectors reach the properly connected state so that the detector can move to the detecting position. However, the resilient locking piece may be deformed down in an abnormal operating direction and may enter the locking hole when the detector is pushed.

The invention was developed in view of the above problem and an object thereof is to prevent a resilient locking piece from being resiliently deformed in an abnormal direction.

SUMMARY OF THE INVENTION

The invention, there relates to a connector with first and second housings that are connectable with each other. A lock arm is provided on the first housing and is inclined relative to the first housing at an intermediate stage of a connecting operation of the housings. At least one detector is assembled into the first housing and is movable between a standby position and a detecting position. A resilient locking piece is provided on the detector and projects towards the second housing. A movement restricting means is provided in the first housing or the lock arm for restricting movements of the detector. The movement restricting means normally prevents the detector from moving from the standby position to the detecting position. However, the movement restricting means is released when the housings are connected properly so that the detector can move to the detecting position to detect a connected state of the housings. An abnormal deformation preventing means is provided on the resilient locking piece or the lock arm for preventing the resilient locking piece from deforming in an abnormal direction as the detector is moved. Accordingly, the resilient locking piece can be deformed only in a normal direction.

A locking hole or recess preferably penetrates the lock arm and is engageable with a lock projection on the second housing to hold the housings properly connected.

The movement restricting means preferably is an engagement of the resilient locking piece with the front wall of the locking hole. The lock projection engages the locking hole or recess and pushes the resilient locking piece away from the lock arm. Thus, the resilient locking piece disengages from the front wall of the locking hole when the lock arm moves over the lock projection and is restored during the connecting operation.

The abnormal deformation preventing means preferably is constructed by engaging bulges that bulge out sideways from the lateral edges of the resilient locking piece with the opening edge of the locking hole.

The resilient locking piece preferably extends substantially along the lock arm.

A dimension of the detector in forward and backward directions is set so that the rear end of the detector is more backward than the rear end of the first housing when the detector is at the standby position. However, the rear end of the detector preferably is flush with the rear end of the first housing when the detector is at the detecting position. Accordingly, the connector provides an easy and clear visual indication when the detector has not been pushed sufficiently from the standby position to the detecting position. Further, the rear end of the detector does not project uselessly beyond the rear end of the housing when the detector is at the detecting position.

The detector preferably cooperates with the lock arm to doubly lock the housings when the detector is moved to the detecting position.

Protection walls preferably project on the housing at the lateral sides of the lock arm and extend in substantially forward and backward directions over at least part of the length of the housing. Thus, protection walls restrict transverse displacement of the detector.

Guiding ribs preferably bulge from lateral edges of the lock arm and extend in substantially forward and backward directions. Additionally, hook-shaped mounting portions preferably are formed on the detector and extend in substantially forward and backward directions. The detector can be slid from behind and mounted on the lock arm. Additionally, the mounting portions of the detector can engage the guiding ribs of the lock arm to prevent an outward detachment of the detector.

Retaining pieces preferably are formed on the detector for resilient deformation in the transverse direction, and locking claws preferably project in near the front ends of the retaining pieces. Engaging portions preferably project out from the edges of the lock arm and are engageable with the locking claws to hold the detector at the standby position.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
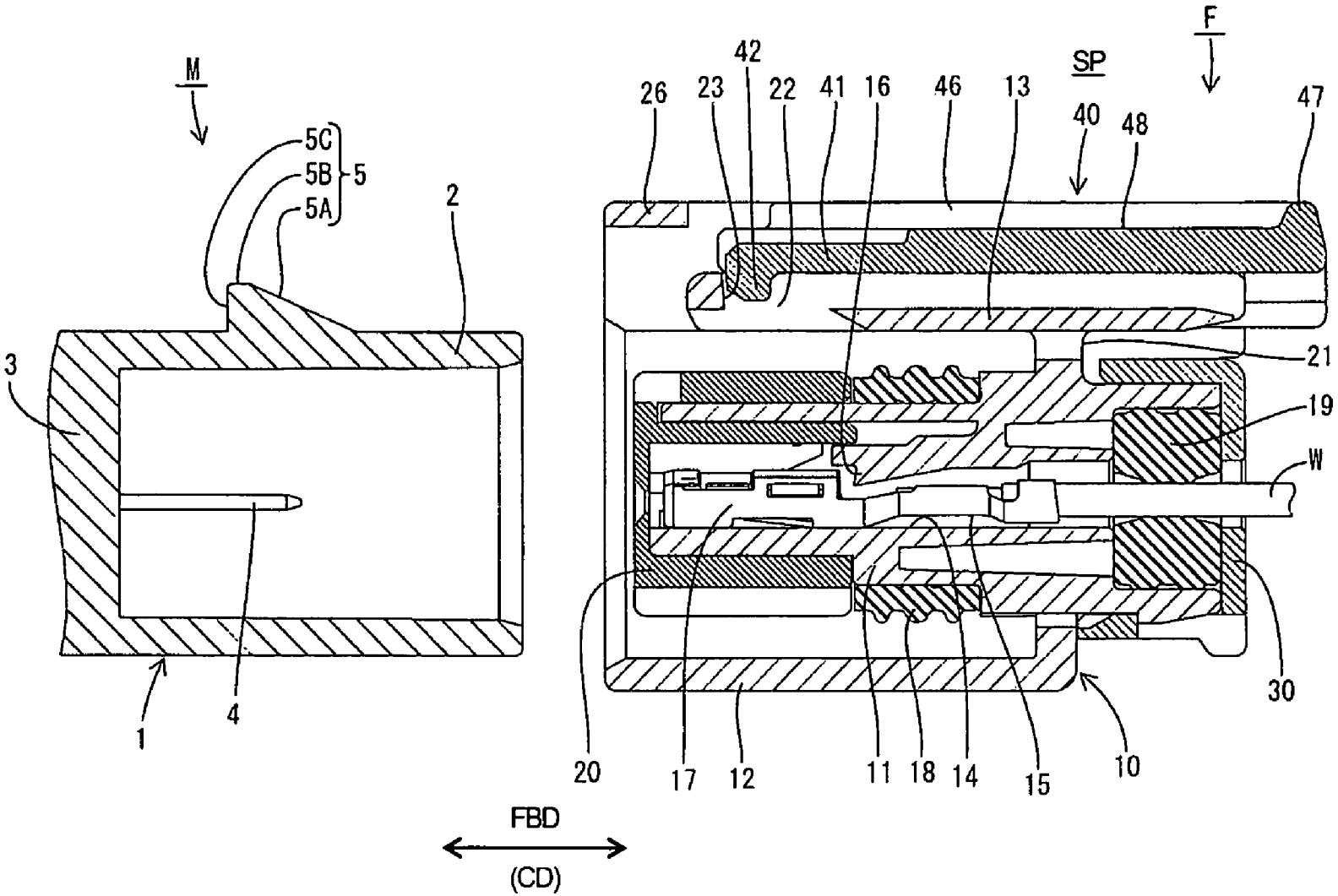
FIG. 1 is a longitudinal section of two connectors according to one preferred embodiment before being connected.
Figure 9:
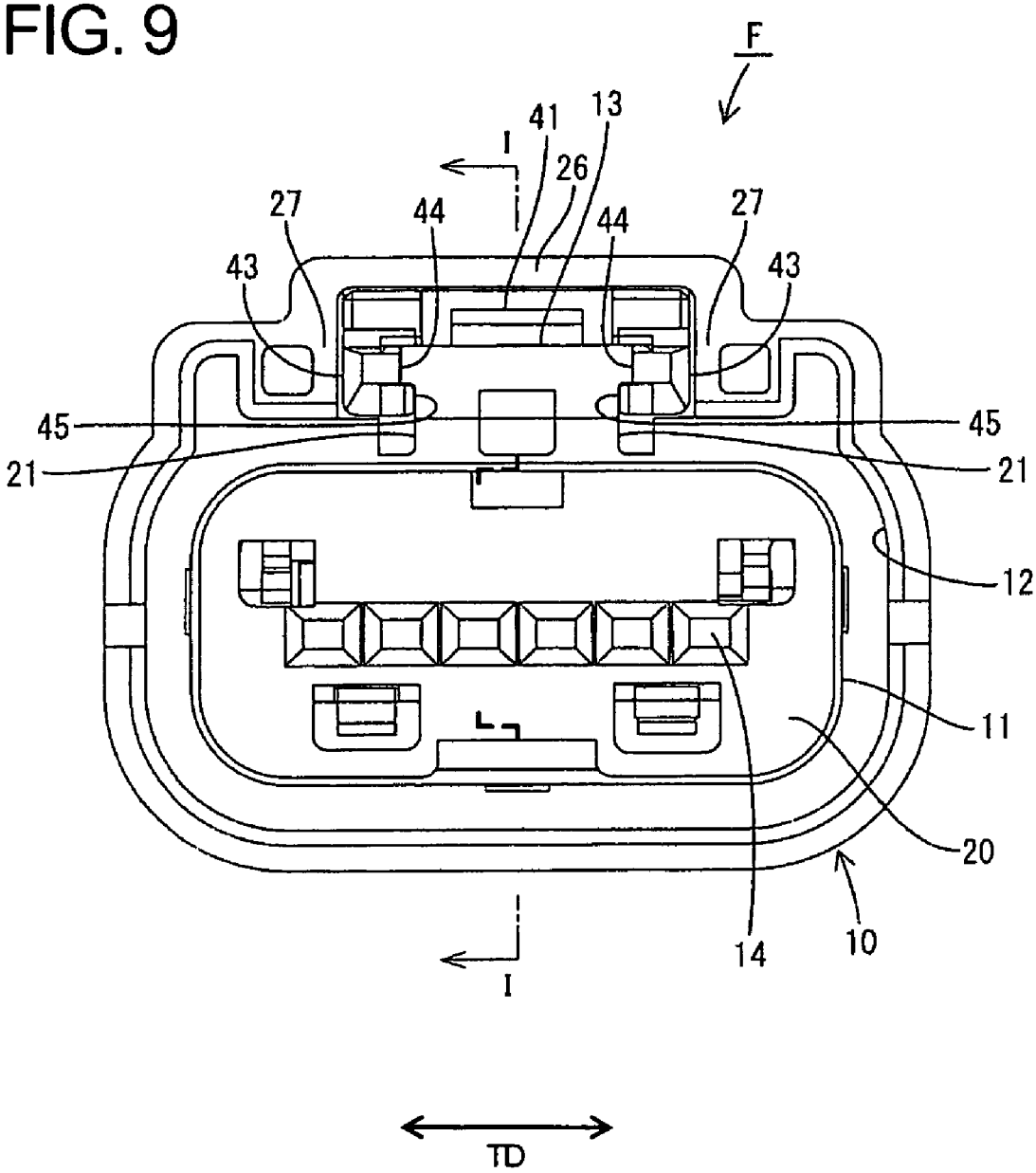
FIG. 9 is a front view of the female connector.
Figure 10:
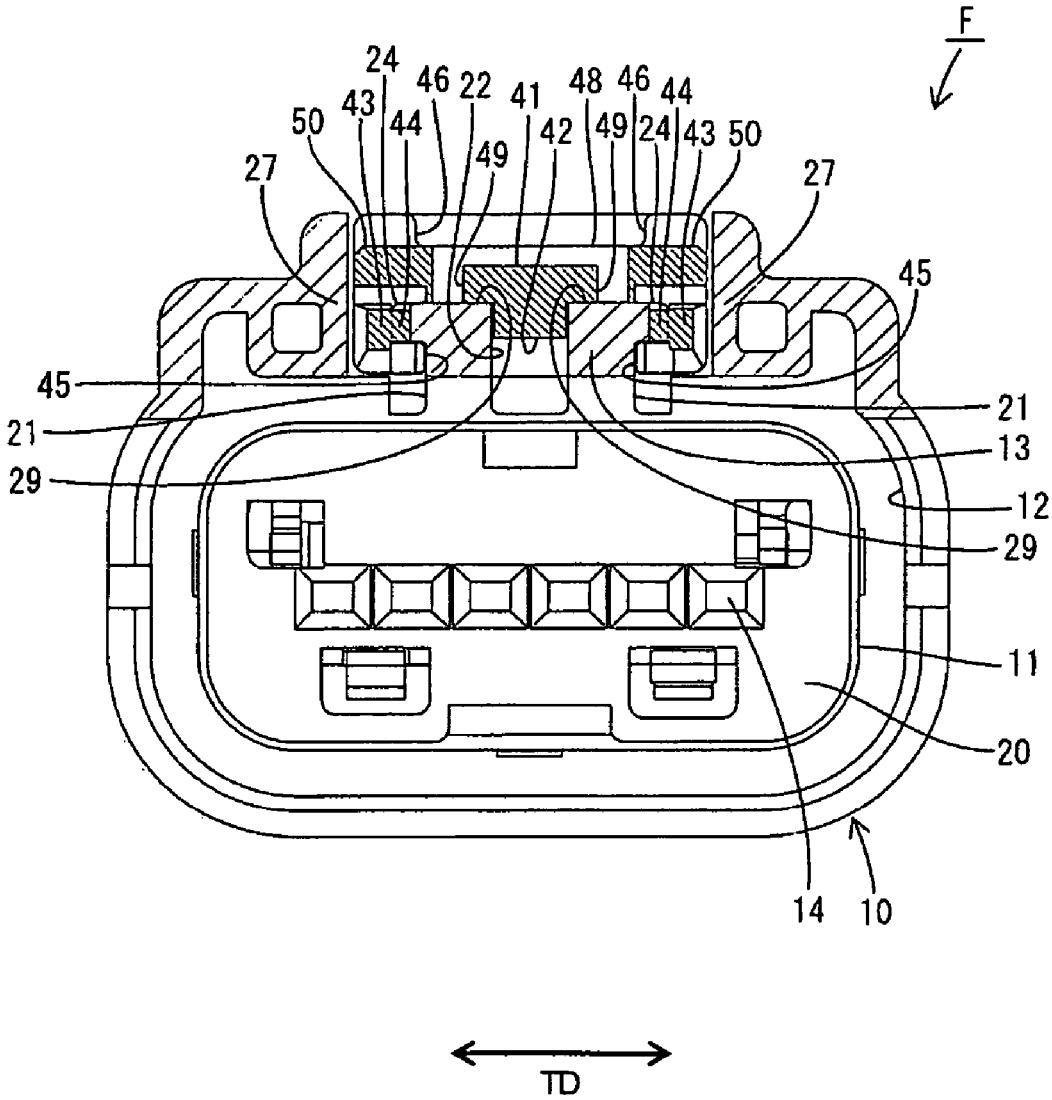
FIG. 10 is a section along X-X of FIG. 8.

A connector assembly according to the invention has a female connector F and a male connector M that are connectable with each other, as shown in FIG. 1. In the following description, ends of the two housings that are to be connected are referred to as fronts concerning forward and backward directions FBD and reference is made to FIGS. 9 and 10 concerning vertical and transverse directions TD.

The male connector M has a male housing 1 made e.g. of a synthetic resin. The male housing 1 includes a receptacle 2 having an open front end. The receptacle 2 has a back wall 3 and male terminal fittings 4 project forward from the back wall 3 into the receptacle 2. A lock projection 5 is provided on the upper surface of the receptacle 2. The lock projection 5 has a sliding-contact surface 5A that slopes moderately up and out towards the back. A push-up surface 5B extends back from the rear end of the sliding-contact surface 5A substantially along the connecting direction CD of the connectors F, M and substantially parallel to the upper surface of the receptacle 2. A locking surface 5C extends substantially vertically in and down from the rear end of the push-up surface 5B to the upper surface of the receptacle 2.

The female connector F has a female housing 10 made e.g. of a synthetic resin and includes a substantially block-shaped main body 11. A fitting tube 12 surrounds the main body 11 and has an open front end, and a lock arm 13 is formed at the upper surface of the main body 11. Cavities 14 penetrate the main body 11 in substantially forward and backward directions FBD and female terminal fittings 15 connected with wires W are insertable into the cavities 14 from behind. A resiliently deformable lock 16 projects down and in from the ceiling surface of each cavity 14, and engages a rear end of a tube portion 17 of the female terminal fitting 15 to prevent the female terminal fitting 15 from coming out backward. A front retainer 20 is mounted on the front surface of the main body 11 and has locking pieces. The rear end of the front retainer 20 enters deformation spaces for the locks 16 to lock the female terminal fittings 15 redundantly.

A seal ring 18 is mounted on the outer periphery of the main body 11, and forward detachment of the seal ring 18 is prevented by the front retainer 20. On the other hand, a rearwardly open receptacle is formed at the rear end of the main body 11, and a one-piece resilient or rubber plug 19 is inserted into the receptacle from behind for sealing the wires W. A plug pressing member 30 is mounted on the rear of the main body 11 to prevent a backward detachment of the plug 19. The female terminal fittings 15 connected with the wires W can be inserted through the plug 19 and into the cavities 14. Thus, the seal ring 18 and the plug 19 prevent entrance of water or other fluid into the main body 11.

A long lock arm 13 extends in forward and backward directions FBD on the upper surface of the main body 11 and is connected with the upper surface of the main body 11 by a support 21 at a position slightly behind its longitudinal middle. The lock arm 13 normally is in a locking posture where it is substantially parallel with the upper surface of the main body 11, but is resiliently inclinable like a seesaw about the support 21 to assume an unlocking posture in which the front end of the lock arm 13 is displaced up and away from the upper surface of the main body 11. The front upper edge of the lock arm 13 is slanted or rounded. A locking hole 22 vertically penetrates the front part of the lock arm 13, and a front wall 23 is defined at the front of the locking hole 22. Guiding ribs 24 bulge out laterally from the opposite left and right edges of the lock arm 13 and extend in forward and backward directions FBD.

Two protection walls 27 stand from the upper surface of the main body 11 at the opposite left and right sides of the lock arm 13. The protection walls 27 extend in substantially forward and backward directions FBD over substantially the entire length of the female housing 10. A coupling 26 couples the upper edges of the front ends of both protection walls 27.

Figure 11:
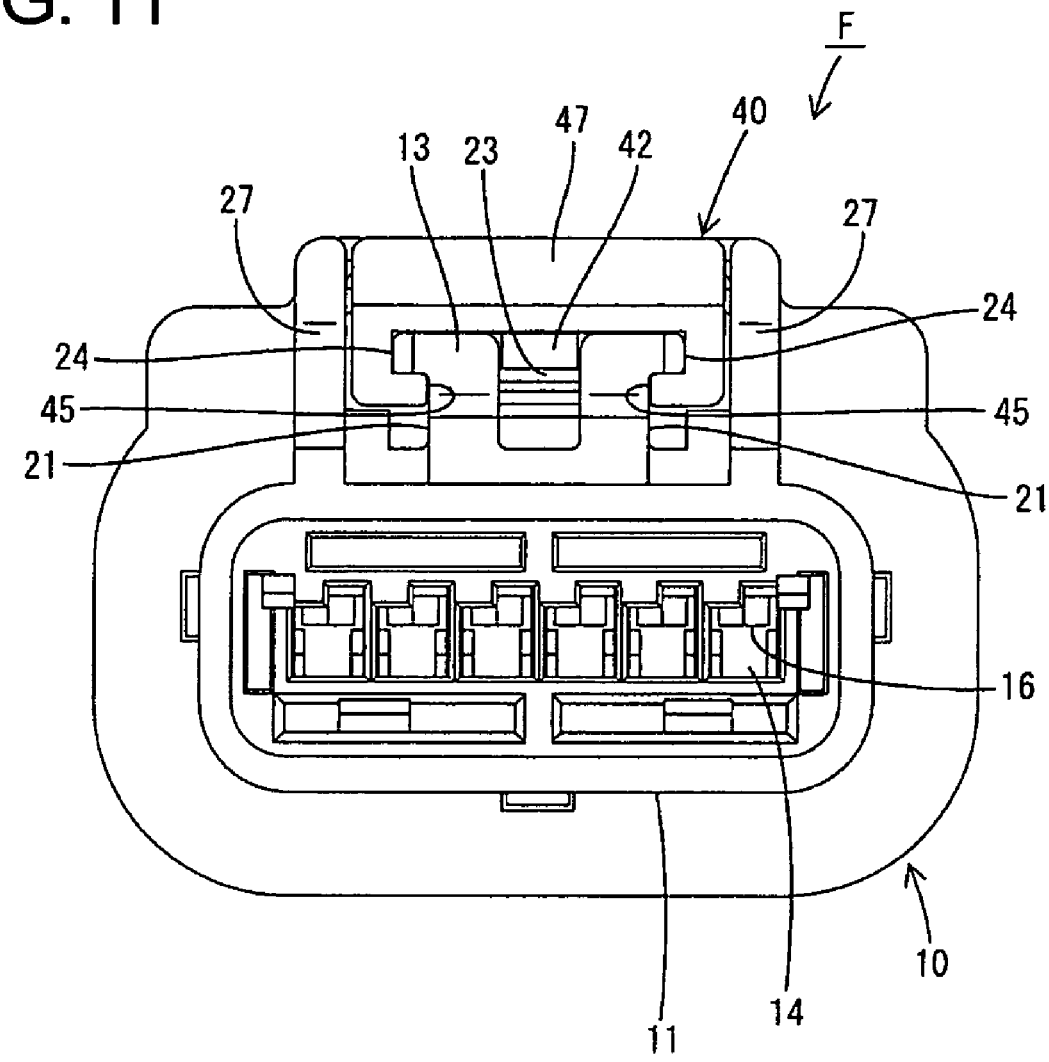
FIG. 11 is a rear view of the female connector of the embodiment.
Figure 14:
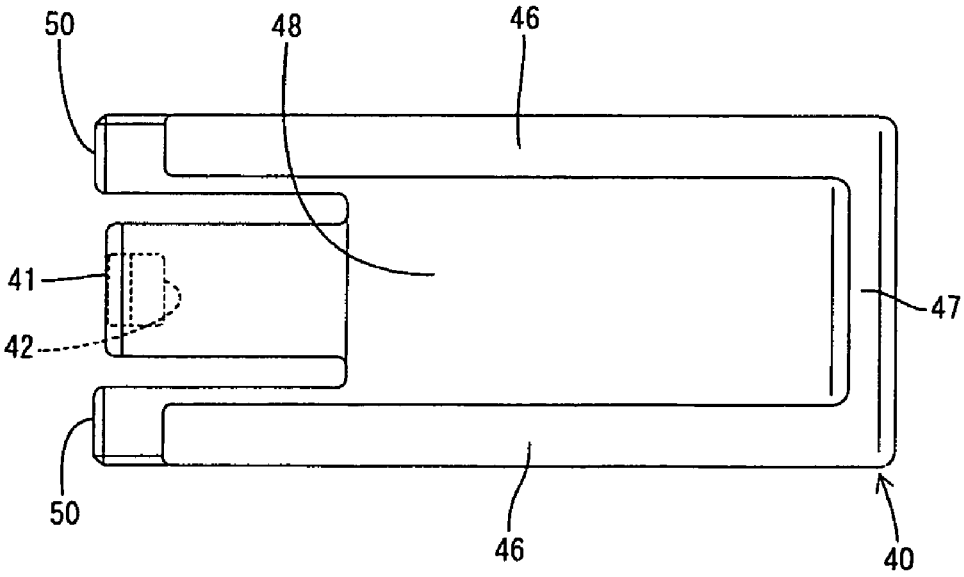
FIG. 14 is a plan view of a detector.
Figure 15:
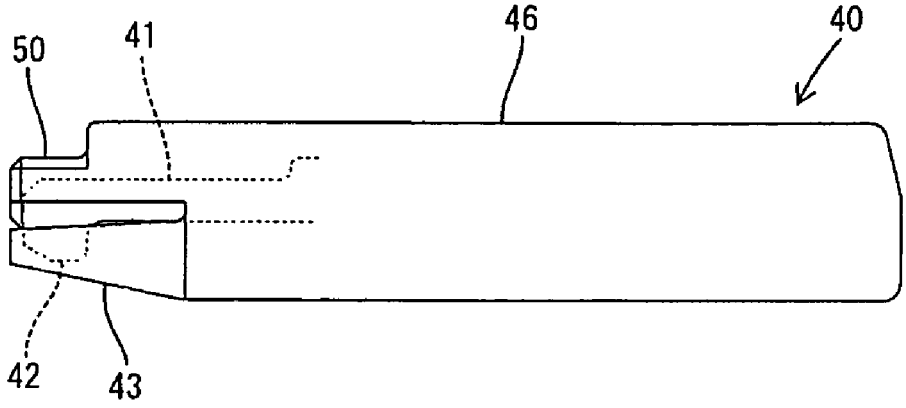
FIG. 15 is a side view of the detector.
Figure 17:
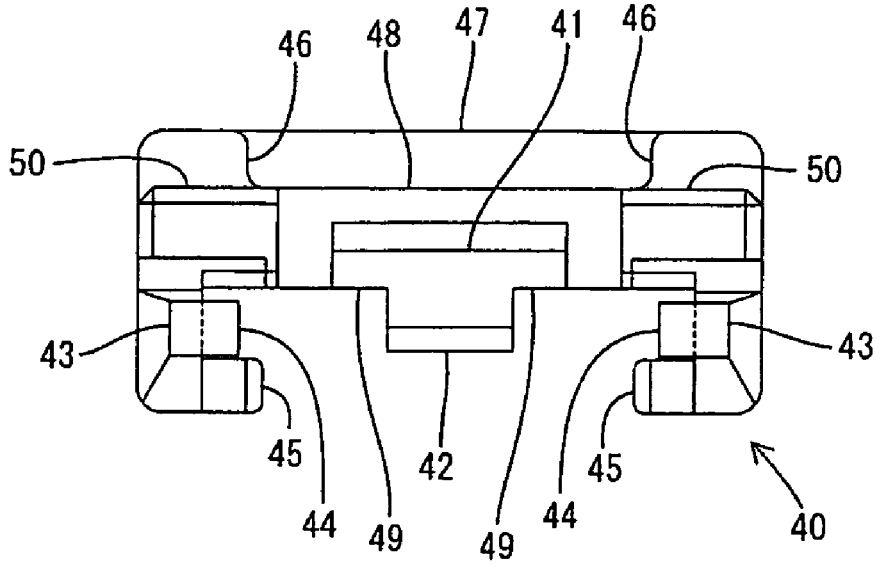
FIG. 17 is a front view of the detector.
Figure 18:
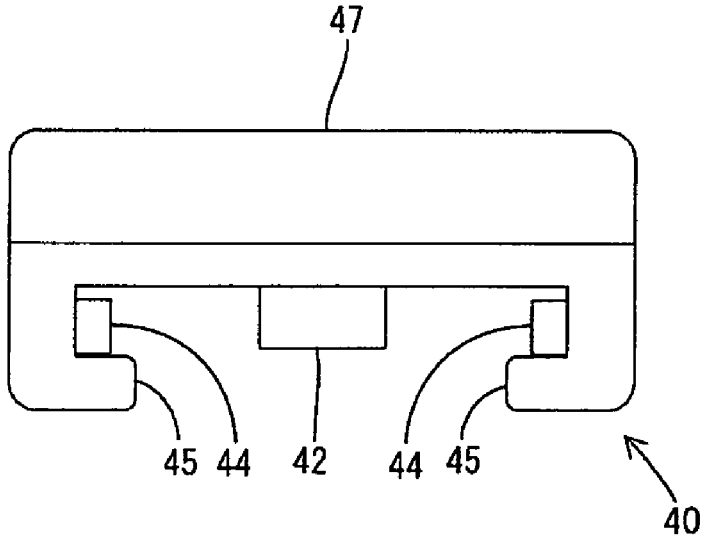
FIG. 18 is a rear view of the detector.

The female connector F also includes a detector 40. The detector 40 is made e.g. of a synthetic resin and has a plate-shaped main portion 48, as shown in FIG. 14 or 15. Hook-shaped mounting portions 45 extend in substantially forward and backward directions FBD on the bottoms of the opposite left and right edges of the main portion 48, as shown in FIG. 17. The detector 40 can be slid from behind and mounted on the upper surface of the lock arm 13 by engaging the mounting portions 45 with the respective guiding ribs 24 of the lock arm 13. The engagement of the guiding ribs 24 and the mounting portions 45 prevents an upward detachment of the detector 40 and the protection walls 27 prevent transverse displacement of the detector 40, as shown in FIG. 11. The detector 40 is resiliently inclinable together with the lock arm 13 during connection and separation of the connectors F, M, as shown in FIGS. 1 to 5. On the other hand, the opposite left and right edges of the main portion 48 are thickened at the upper side to form reinforcing ribs 46 unitary to the main portion 48, and an unlocking portion 47 unitarily couples the rear ends of both reinforcing ribs 46, as shown in FIG. 14. A transverse dimension of the detector 40 is equal to or slightly less than a distance between the protection walls 27. Additionally, the detector 40 is at the same height as or slightly lower than the upper ends of the protection walls 27 when the detector 40 is mounted on the upper surface of the lock arm 13, as shown in FIG. 1. Thus, the lock arm 13 and the detector 40 are protected from impacts from the outside The detector 40 is mounted for movement relative to the lock arm 13 along forward and backward directions FBD between the standby position SP shown in FIG. 1 and the detecting position DP shown in FIG. 4. A dimension of the detector 40 in forward and backward directions FBD is set so that the rear end of the detector 40 is more backward than the rear end of the female housing 10 when the detector 40 is at the standby position SP while being substantially flush with the rear end of the female housing 10 when the detector 40 is at the detecting position DP. Further, the front ends of the reinforcing ribs 46 contact the rear end of the coupling piece 26 so that the detector 40 does not move forward beyond the detecting position DP.

Figure 7:
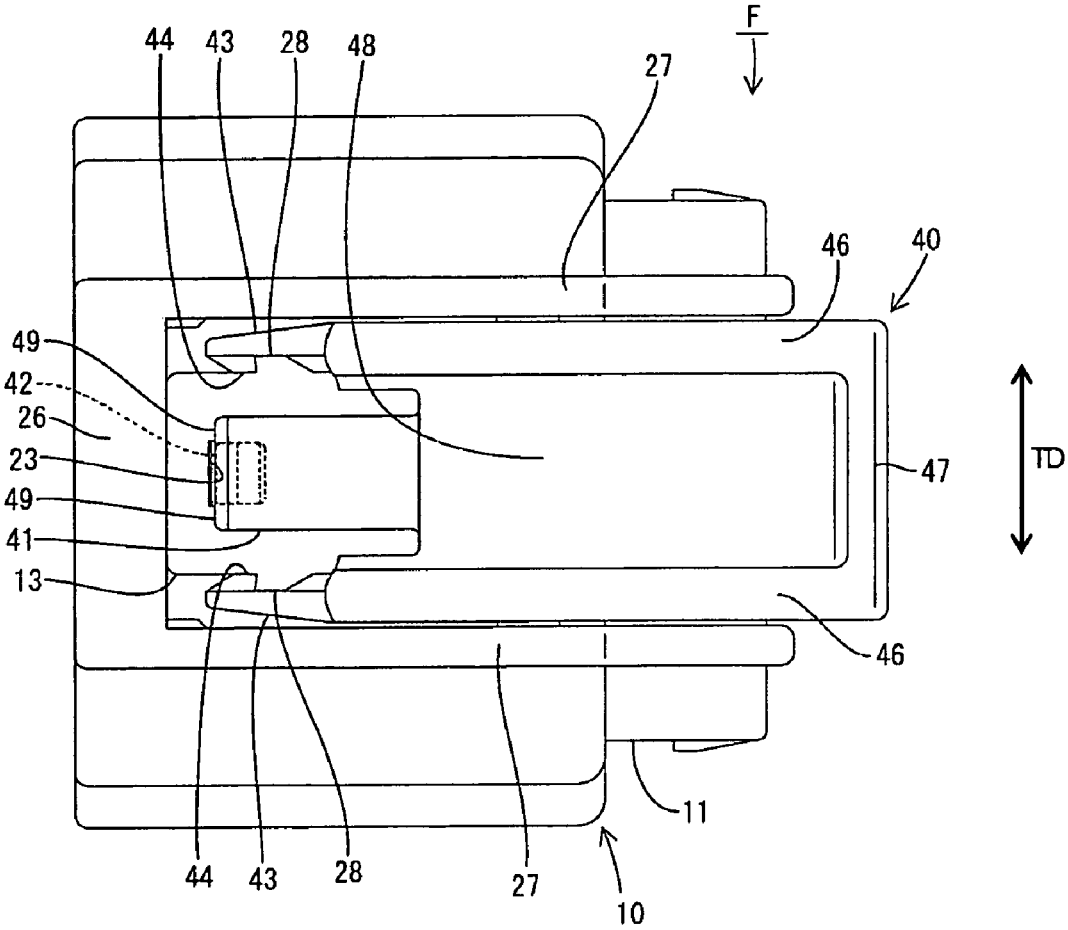
FIG. 7 is a plan view partly in section of the female connector.
Figure 8:
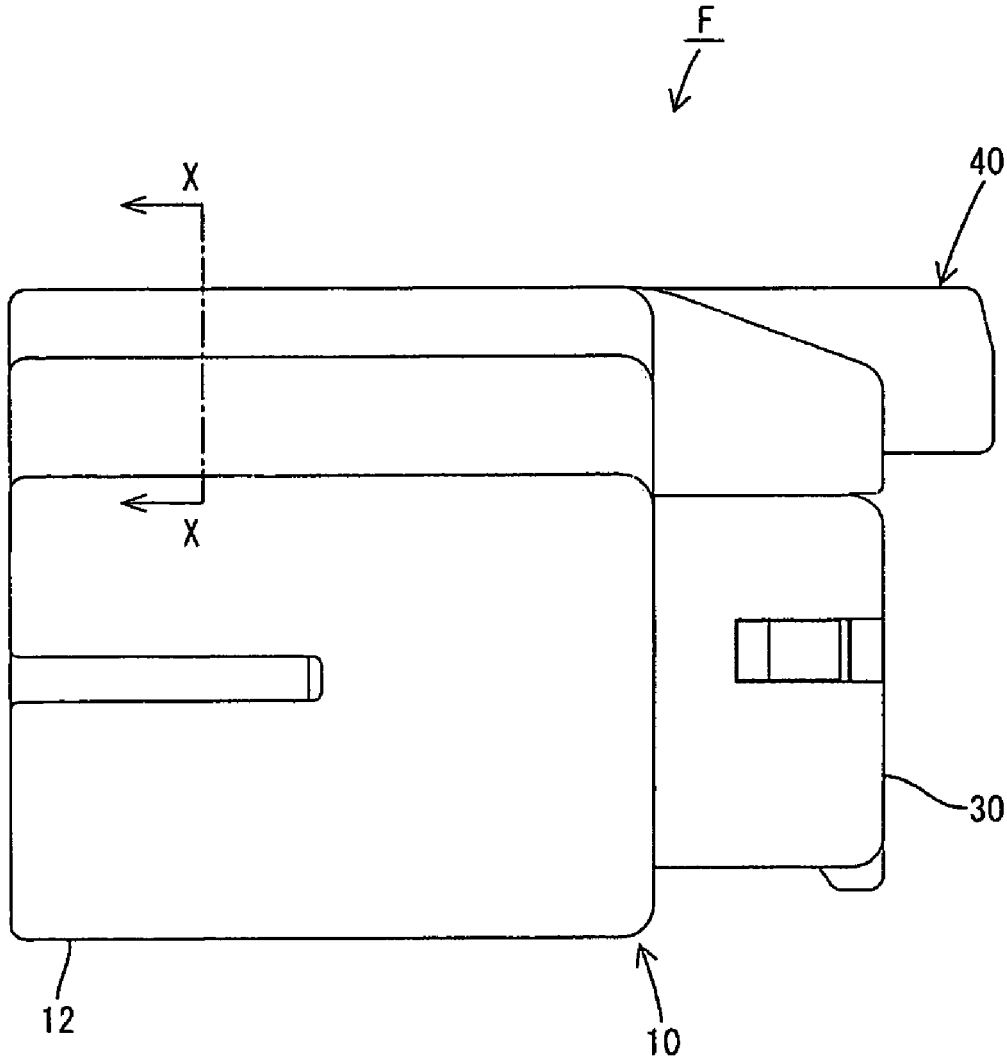
FIG. 8 is a side view of the female connector.
Figure 12:
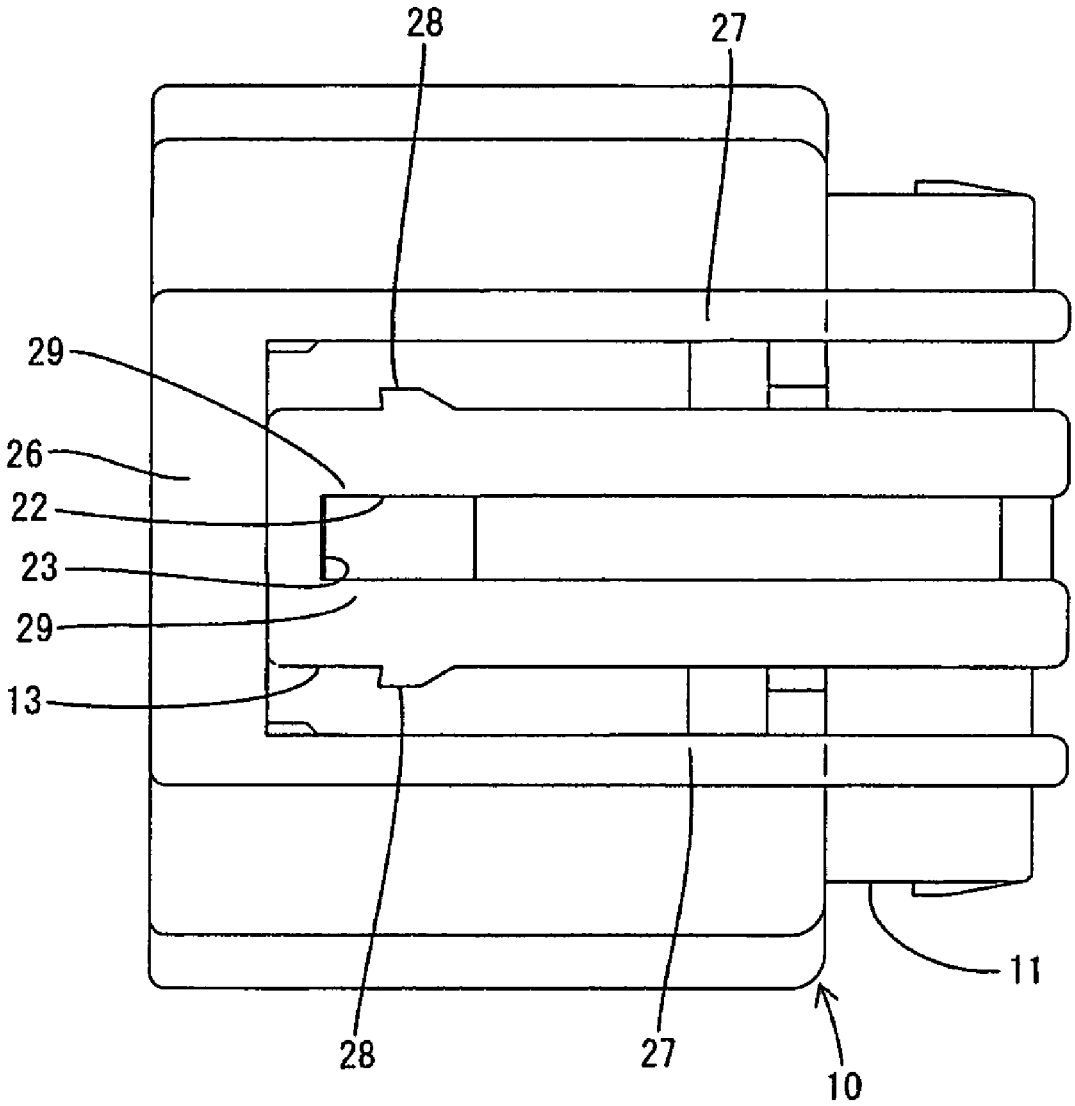
FIG. 12 is a plan view of a female connector housing.
Figure 13:
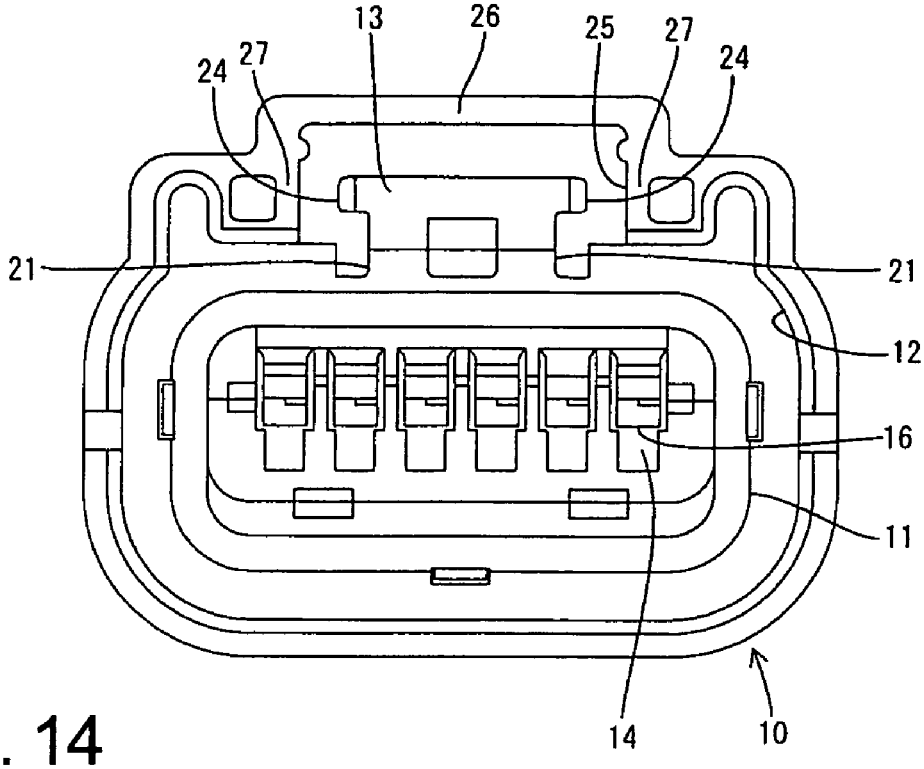
FIG. 13 is a front view of the female connector housing.
Figure 16:
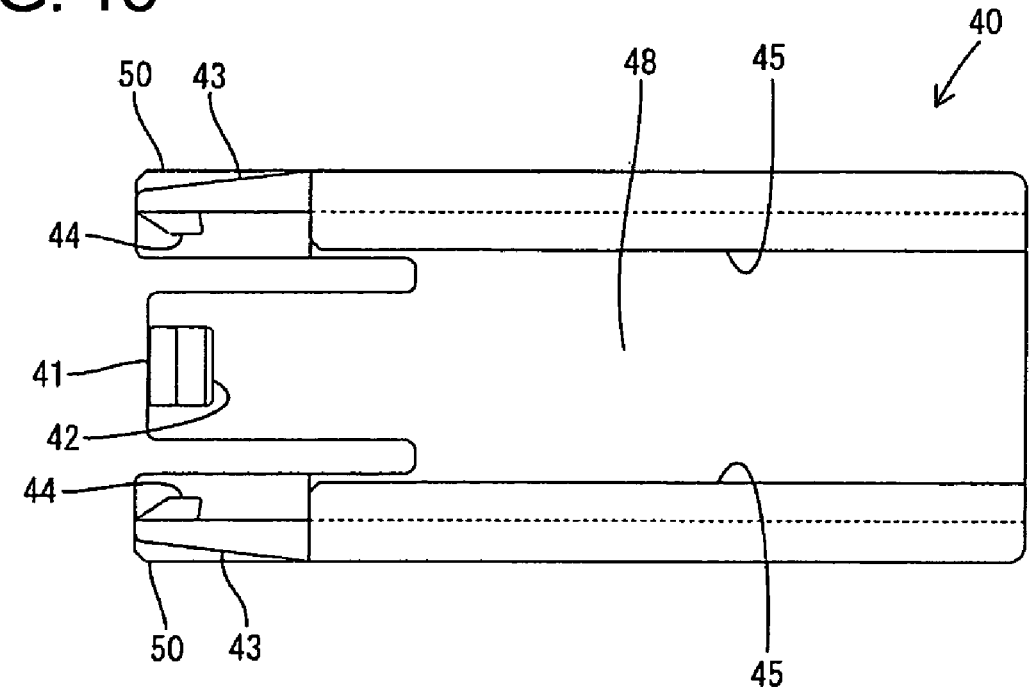
FIG. 16 is a bottom view of the detector.

Retaining pieces 43 project forward from the front ends of the mounting portions 45, as shown in FIG. 16, and are resiliently deformable in the transverse direction TD. Locking claws 44 project in at the front ends of the retaining pieces 43. On the other hand, engaging portions 28 project out from the opposite left and right edges of the front side of the lock arm 13, as shown in FIG. 12, and the locking claws 44 can engage the corresponding engaging portions 28, as shown in FIG. 7. In this way, the detector 40 is held firmly at the standby position SP so as not to come off backward. Protection covers 50 project forward at the front ends of the reinforcing ribs 46 and cover the retaining pieces 43 from above to prevent the engaged positions of the locking claws 44 and the engaging portions 28 from being exposed to the outside when the detector 40 is mounted on the upper surface of the lock arm 13.

Figure 2:
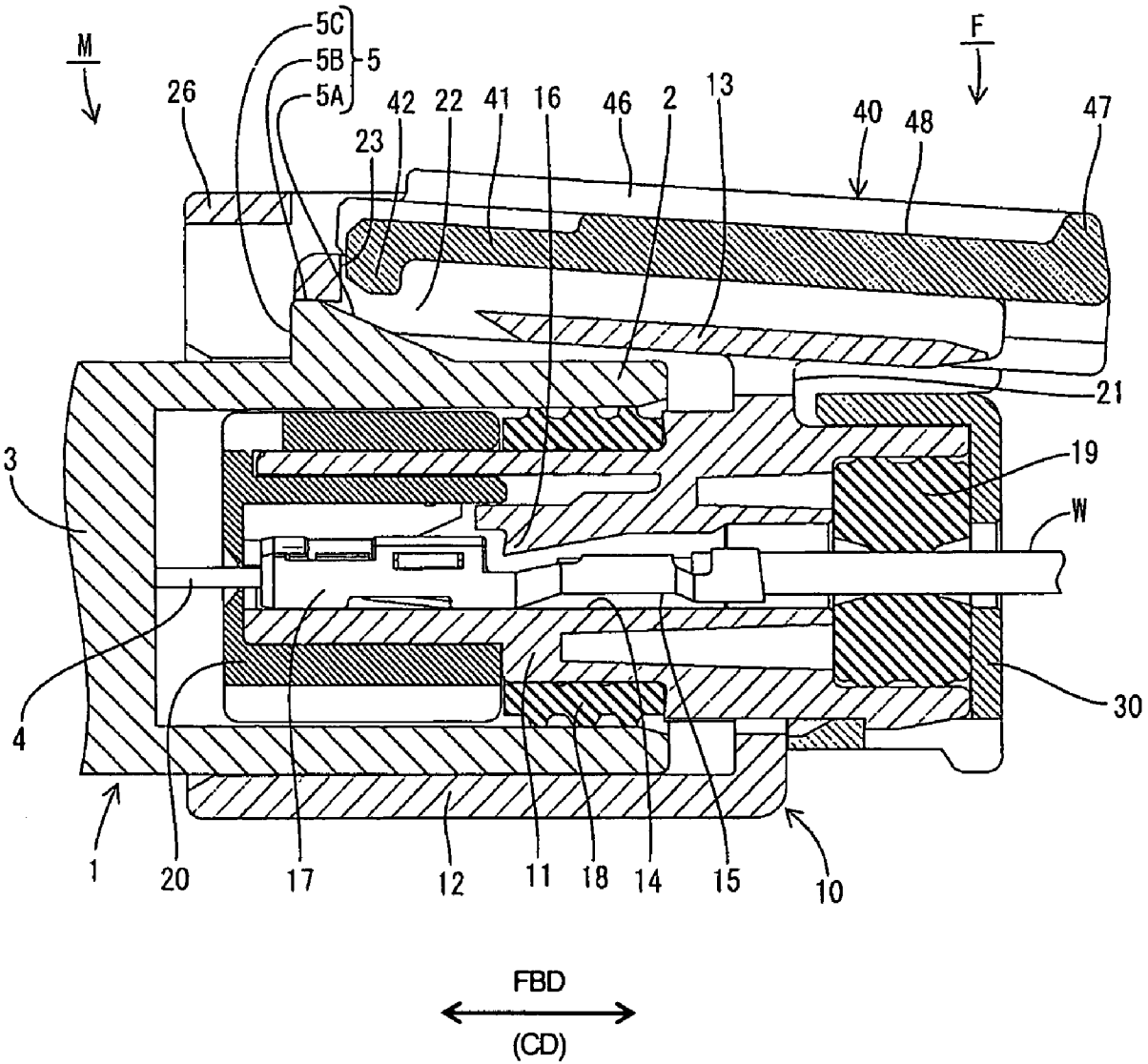
FIG. 2 is a section of the two connectors at an intermediate stage of a connecting operation.
Figure 3:
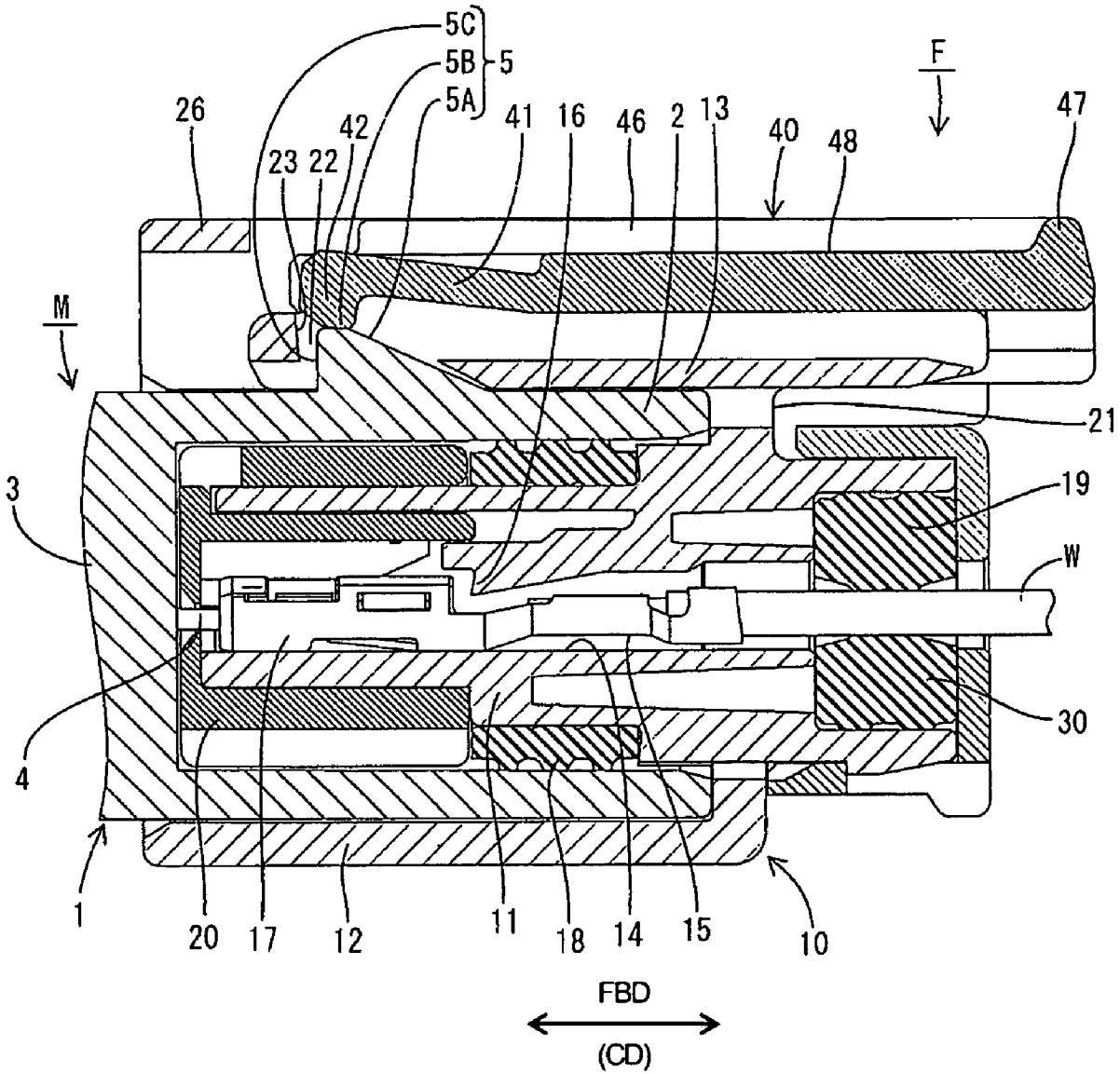
FIG. 3 is a section of the two connectors at a more advanced stage of a connecting operation.

As shown in FIG. 14, the resilient locking piece 41 cantilevers forward from a position on the front end of the main portion 48 between the retaining pieces 43. The locking section 42 projects in and down at the front end of the resilient locking piece 41, and is vertically displaceable with the base end of the resilient locking piece 41 as a support. At the standby position SP shown in FIGS. 1 and 2, the resilient locking piece 41 normally is in a locked posture above the locking hole 22 and the locking section 42 at the front end thereof contacts the front wall 23. However, as shown in FIG. 3, the resilient locking piece 41 can incline resiliently to locate the locking section 42 above the front wall 23, trying to move over the front wall 23. Upon reaching the detecting position DP shown in FIG. 4, the resilient locking piece 41 is restored resiliently to assume a locking posture engaged with the front end of the lock arm 13.

Figure 4:
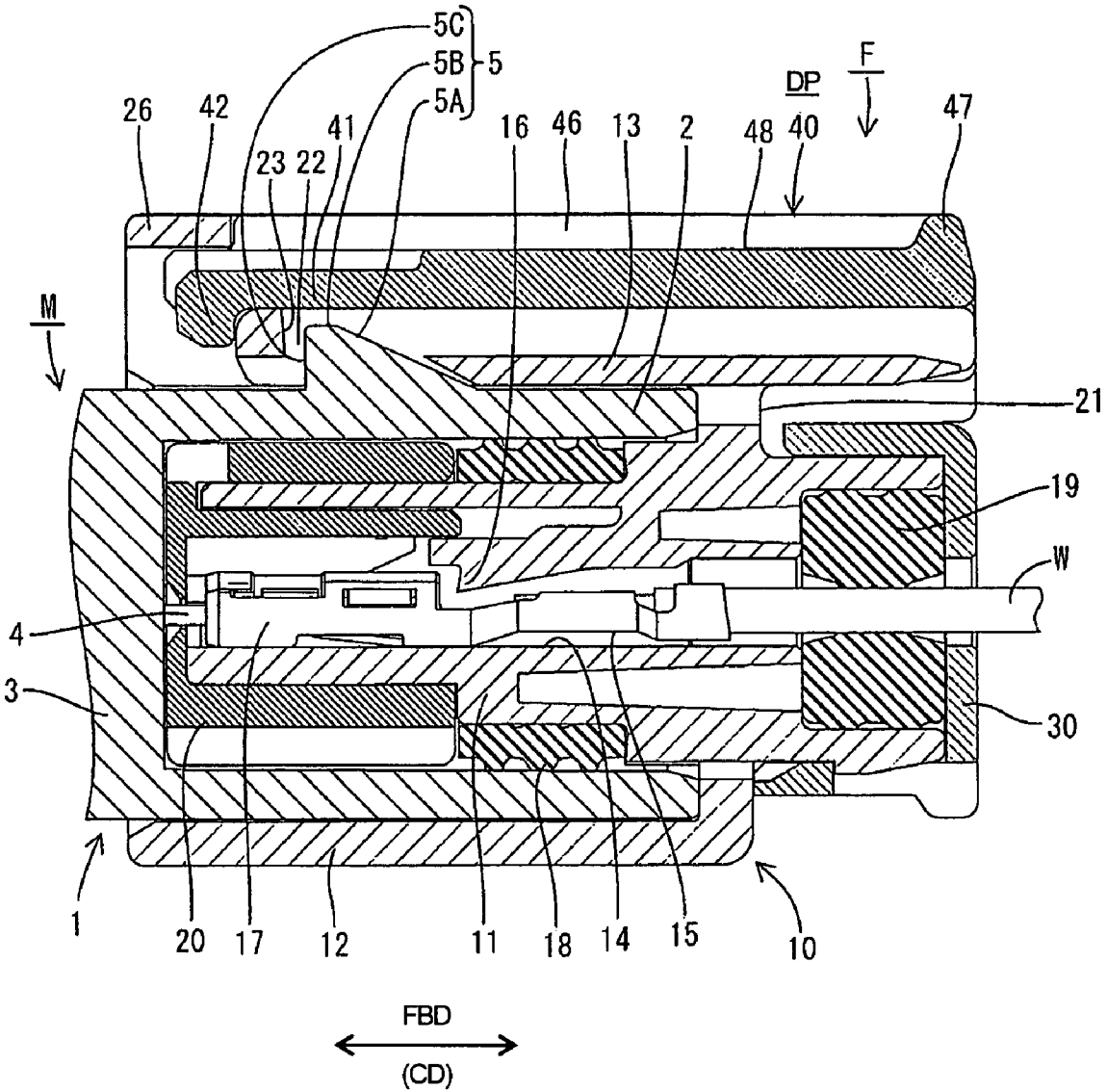
FIG. 4 is a section of the two connectors properly connected.

The resilient locking piece 41 may move over the front end of the lock arm 13 if the detector 40 is pushed from behind to a position shown in FIG. 4 before the connectors F, M are connected. However, the front upper portion of the resilient locking piece 41 contacts the lower surface of the coupling 26 to hinder an inclining movement of the lock arm 13 and to prevent connection of the connectors F, M. Thus, an abnormal connecting operation can be detected. The detector 40 is pushed forward when the lock arm 13 is inclined during the connecting operation of the connectors F, M as shown in FIG. 2. Thus, the front end of the resilient locking piece 41 contacts the rear end of the coupling 26 to prevent any further forward movement of the detector 40 and to detect the partial connection of the connectors F, M. The spacing between the front end of the lock arm 13 and the coupling 26 permits the detector 40 to move singly back while the resilient locking piece 41 is deformed out and up while separating the connectors F, M from the properly connected state shown in FIG. 4. However, even if an attempt is made to press an unlocking portion 47 down and in with the detector 40 held at the position shown in FIG. 4, the front upper portion of the resilient locking piece 41 contacts the lower surface of the coupling piece 26, thereby hindering an inclining movement of the lock arm 13. Therefore, the two connectors F, M cannot be separated and an abnormal separating operation can be detected.

Bulges 49 bulge out sideways at the opposite lateral edges of the resilient locking piece 41 (see FIG. 17). The bulges 49 are engageable with an opening edge 29 of the locking hole 22 at the upper surface of the lock arm 13 to prevent the resilient locking piece 41 from undergoing a deformation that would move the locking section 42 into the locking hole 22. This ensures that the resilient locking piece 41 will deform only in a proper direction.

The detector 40 initially is mounted to the female housing 10 from behind and between the protection walls 27. As a result, the mounting portions 45 of the detector 40 engage the guiding ribs 24 of the lock arm 13. The engaging pieces 28 cause the retaining pieces 43 of the detector 40 to deform resiliently out in the transverse direction TD. However, the locking claws 44 move over the engaging portions 28 as the detector 40 is moved forward, and the retaining pieces 43 resiliently restore when the detector 40 reaches the standby position SP. Thus, the locking claws 44 engage the engaging portions 28, as shown in FIG. 7. In this way, the detector 40 at the standby position SP is prevented from moving up, back or in the transverse direction TD. Further, the engagement of the locking section 42 of the resilient locking piece 41 and the front wall 23 of the locking hole 22 prevents the detector 40 from moving from the standby position SP towards the detecting position DP.

The rear end of the detector 40 is more backward than the rear end of the female housing 10 when the detector 40 is at the standby position SP, thereby making it easy to recognize that the detector 40 is at the standby position SP. An excessive forward pushing force on the detector 40 conceivably could disengage the locking section 42 from the front wall 23. However, the bulges 49 on the resilient locking piece 41 engaged the opening edge 29 of the locking hole 22 at the upper surface of the lock arm 13. Thus, the resilient locking piece 41 cannot deform down in an abnormal direction that would insert the locking section 42 into the locking hole 22. Therefore, the resilient locking piece 41 only can be deformed resiliently up in the proper direction. If the resilient locking piece 41 is deformed resiliently up and the detector 40 is pushed to the detecting position DP before the two connectors F, M are connected, the upper surface of the locking section 42 of the resilient locking piece 41 contacts the lower surface of the coupling piece 26 to prevent an inclination of the lock arm 13. Thus, the two connectors F, M cannot be connected and an abnormally connected state can be detected.

The two connectors F, M are connected by inserting the front end of the receptacle 2 of the male connector M into the space between the main body 11 of the female connector F and the fitting tube 12. The sliding-contact surface 5A of the lock projection 5 engages the front end of the lock arm 13 and causes the front of the lock arm 13 to tilt up. The detector 40 inclines together with the lock arm 13, as shown in FIG. 2, while being held at the standby position SP. The front end of the lock arm 13 moves over the lock projection 5 and the locking hole 22 aligns with the lock projection 5 when the two connectors F, M are connected properly. As a result, the lock arm 13 is restored resiliently so that the lock projection 5 enters the locking hole 22 from below. Accordingly, the locking surface 5C of the lock projection 5 engages the front wall 23. The push-up surface 5*b* of the lock projection 5 pushes the locking section 42 of the resilient locking piece 41 up and away from the lock arm 13 and the locking section 42 of the deformed resilient locking piece 41 disengages from the front wall 23, as shown in FIG. 3. The detector 40 then is pushed forward along the connecting direction CD towards the detecting position DP while the resilient locking piece 41 is deformed. The front ends of the reinforcing ribs 46 contact the rear end of the coupling piece 26 to stop the detector 40 at the detecting position DP. At this time, the locking section 42 of the resilient locking piece 41 is aligned with the space between the front end of the lock arm 13 and the coupling piece 26. Thus, the resilient locking piece 41 restores resiliently and the locking section 42 slides on the arcuate surface at the upper front edge of the lock arm 13, as shown in FIG. 4. Accordingly, the locking section 42 engages the front end of the lock arm 13 and prevents the detector 40 from coming out backward. The rear end of the detector 40 is substantially flush with the rear end of the female housing 10 when the detector 40 is at the detecting position DP. Hence, the detector 40 does not add needlessly to the length of the connector F and provides a clear indication that the two connectors F, M have been connected properly. An attempt could be made to move the detector 40 to the detecting position DP with the connectors F, M partly connected. However, the lock arm 13 will still be inclined, as shown in FIG. 2, and the front end of the locking section 42 will contact the rear end of the coupling piece 26 to prevent movement of the detector 40 to the detecting position DP. The partly connected state of the two connectors F, M can be detected easily.

Figure 5:
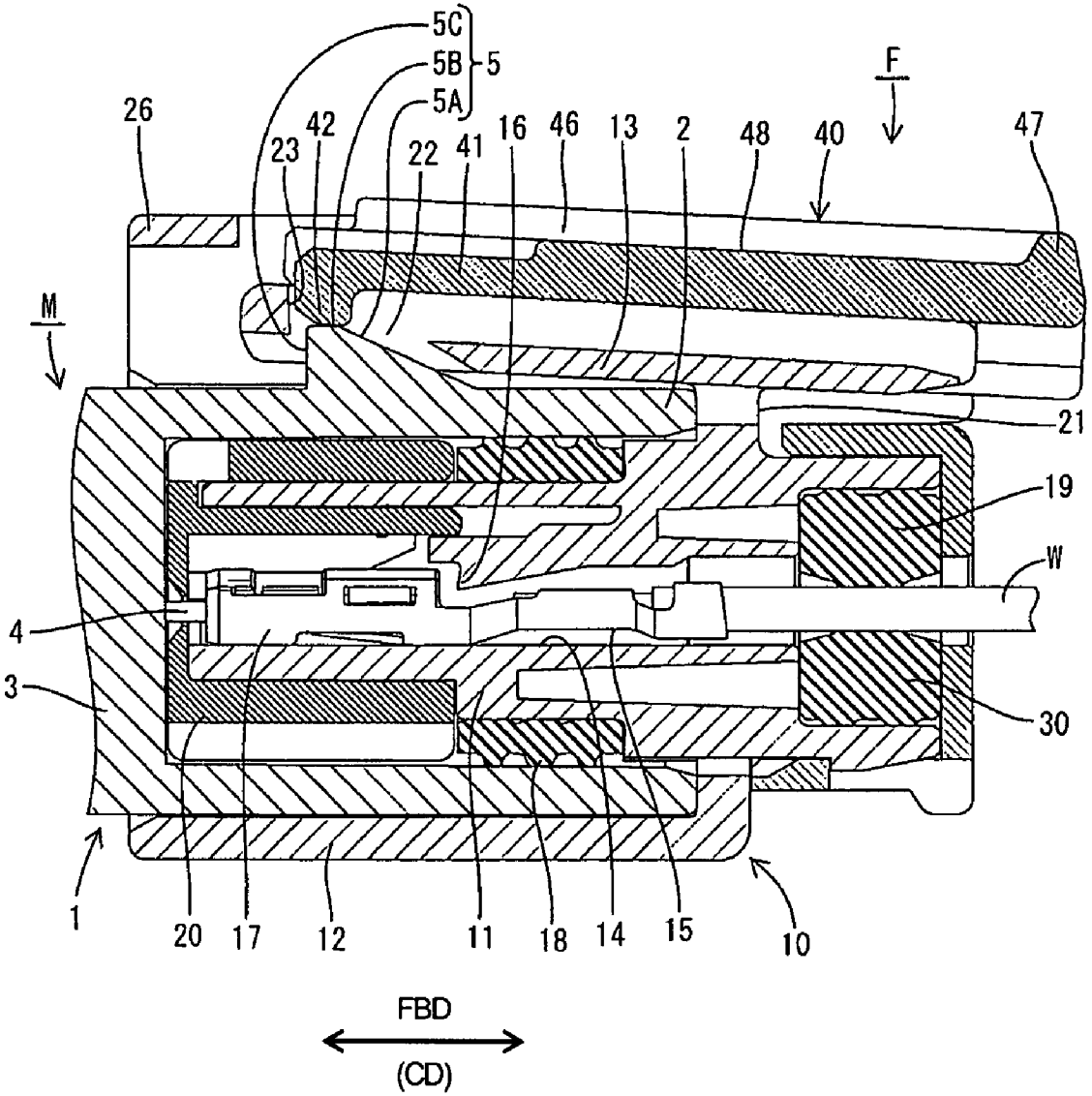
FIG. 5 is a section of the two connectors at an intermediate stage of a separating direction.
Figure 6:
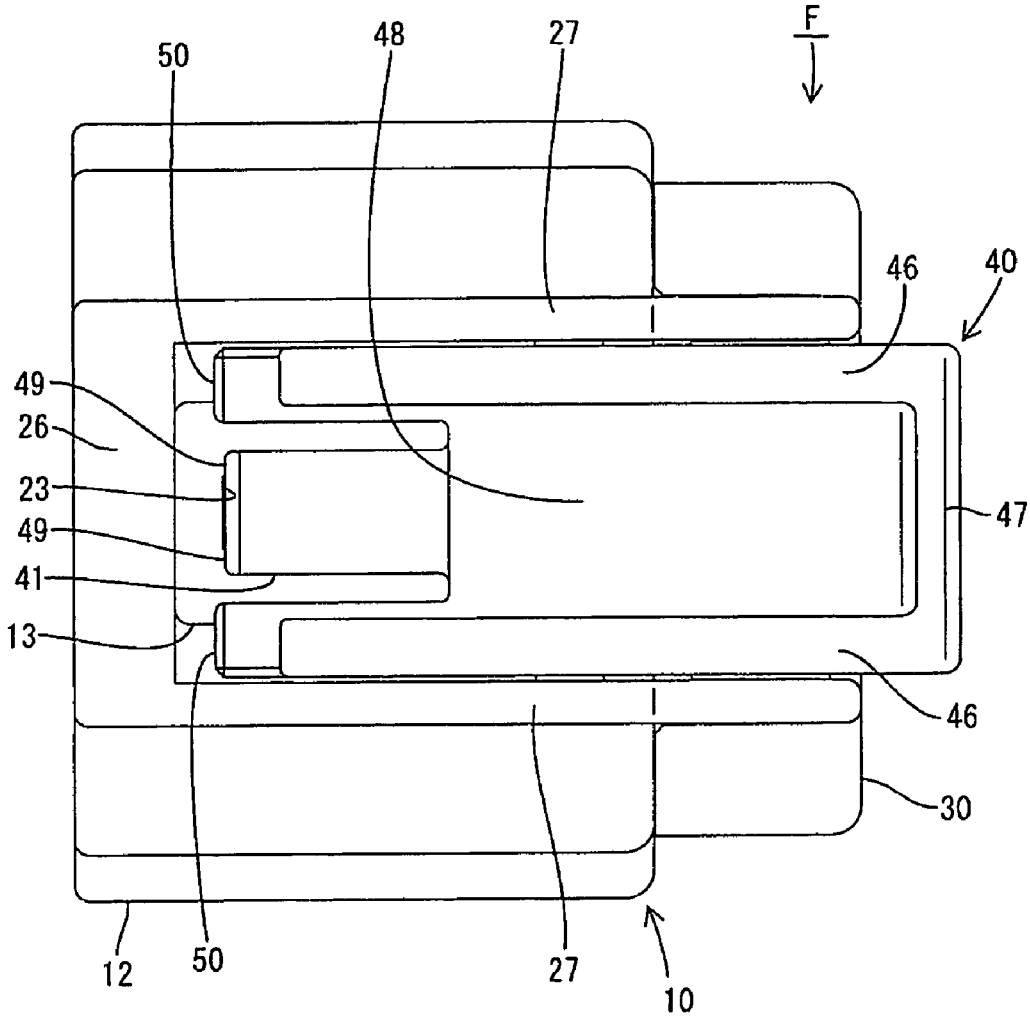
FIG. 6 is a plan view of the female connector.

The detector 40 is pulled back from detecting position DP to separate the connectors F, M. As a result, the locking section 42 slides on the arcuate surface at the upper front end of the lock arm 13, and the resilient locking piece 41 is deformed up and out of engagement with the front end of the lock arm 13. The detector 40 then is moved to the standby position SP. The unlocking portion 47 of the detector 40 then is pushed (e.g. by a finger) to incline the detector 40 and the lock arm 13 together as shown in FIG. 5. The rear end of the detector 40 projects from the rear end of the female housing 10 when the detector 40 is at the standby position SP to ensure a maximally long distance from the support 21. Thus, the unlocking force needed to press the unlocking portion 47 down is minimized. The two connectors F, M can be pulled away from each other and separated when the front wall 23 of the locking hole 22 disengages from the locking surface 5C of the lock projection 5. An attempt could be made to press the unlocking portion 47 down while the detector 40 is held at the detecting position DP. However, the upper surface of the locking section 42 of the resilient locking piece 41 will contact the lower surface of the coupling piece 26 to prevent the lock arm 13 from inclining. This makes it impossible to separate the two connectors F, M, and an abnormal separating operation can be detected. In other words, the detector 40 functions to doubly lock the two connectors F, M in cooperation with the lock arm 13 by being moved from the standby position SP to the detecting position DP.

As described above, the bulges 49 at the opposite lateral edges of the resilient locking piece 41 engage the opening edge 29 of the locking hole 22 at the upper surface of the lock arm 13. Thus, the resilient locking piece 41 cannot deform down and in a way that would insert the locking section 42 into the locking hole 22. As a result, the resilient locking piece 41 can be deformed only in the proper operating direction. Further, the rear end of the detector 40 is more backward than the rear end of the female connector housing 10 when the detector 40 is at the standby position SP. Thus, an operator can easily recognize that the detector 40 is at the standby position SP and will not forget to move the detector 40 to the detecting position DP. Furthermore, when the detector 40 is at the detecting position DP, the rear end of the detector 40 preferably is flush with the rear end of the female housing 10 and does not project uselessly at the detecting position DP.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The detector is mounted on and inclines with the lock arm in the foregoing embodiment. However, the detector need not necessarily be mounted on the lock arm and may be mounted on the female housing.

The foregoing embodiment prevents movement of the detector from the standby position to the detecting position by engaging the locking section of the resilient locking piece of the detector with the front wall of the locking hole in the lock arm. However, the locking section need not necessarily engage the locking hole of the lock arm, and movement of the detector may be prevented by engagement with the female housing according to the invention.

The above-described bulges are on the resilient locking piece. However, they may be on the lock arm or on both the lock arm and the resilient locking piece to prevent abnormal deformation of the resilient locking piece.

The detector is above the lock arm in the foregoing embodiment. However, the detector may be below the lock arm. In such a case, the lock projection exerts a downward pressing force on the detector and disengages from the detector. Thus, resilient deformation of the lock in an approaching direction of the lock projection is prevented.

What is claimed is:

1. An electrical connector assembly comprising:

a first housing having a locking projection formed thereon;

a second housing connectable with the first housing, a resiliently deflectable lock arm formed on the second housing, a locking hole formed in the lock arm and a front wall formed on the lock arm forward of the locking hole, the locking hole being engageable with the locking projection on the first housing to hold the housings in a properly connected state, the lock arm being inclined relative to the second housing at an intermediate stage of a connecting operation of the two housings; and a detector slidably mounted on the lock arm and being movable between a standby position and a detecting position, a resilient locking piece provided on the detector and projecting substantially towards the first housing and at least partly across the locking hole, the resilient locking piece engaging the front wall of the lock arm for restricting movement of the detector from the standby position to the detecting position when the housings are not properly connected, the lock projection being engageable in the locking hole and pushing the resilient locking piece away the front the wall of the locking hole when the lock arm moves over the lock projection and is restored during the connecting operation for permitting movement of the detector to the detecting position when the housings are connected property, thereby detecting a connected state of the two housings, and bulges bulging out from lateral edges of the resilient locking piece for contacting portions of the lock arm adjacent the lock hole and preventing the resilient locking piece from being resiliently deformed into the lock hole as the detector is moved.

2. The connector of claim 1, wherein the resilient locking piece extends substantially along the lock arm.

3. The connector of claim 1, the detector is dimensioned so that a rear end of the detector is more backward than a rear end of the second housing when the detector is at the standby position and so that the rear end of the detector is flush with the rear end of the second housing when the detector is at the detecting position.

4. The connector of claim 1, wherein protection walls project on the second housing at the lateral sides of the lock arm for preventing transverse displacements of the detector.

5. The connector of claim 1, guiding ribs bulge out laterally from lateral edges of the lock arm.

6. The connector of claim 5, wherein hook-shaped mounting portions are formed on the detector and extend substantially in forward and backward directions, the mounting portions being engageable with the respective guiding ribs of the lock arm for preventing an outward detachment of the detector.

7. The connector of claim 1, wherein engaging portions project from edges of the lock arm, retaining pieces being formed on the detector and being resiliently deformable in transverse directions, and locking claws projecting in substantially at front ends of the retaining pieces, the locking claw(s) being engageable with the corresponding engaging portions for holding the detector at the standby position.

* * * * *